US008299004B2

(12) United States Patent
Tsubouchi

(10) Patent No.: US 8,299,004 B2
(45) Date of Patent: Oct. 30, 2012

(54) HYDRAULIC FLUID AND HYDRAULIC SYSTEM

(75) Inventor: Toshiyuki Tsubouchi, Sodegaura (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 334 days.

(21) Appl. No.: 12/597,184

(22) PCT Filed: Apr. 21, 2008

(86) PCT No.: PCT/JP2008/057686

§ 371 (c)(1),
(2), (4) Date: Oct. 23, 2009

(87) PCT Pub. No.: WO2008/133233

PCT Pub. Date: Nov. 6, 2008

(65) Prior Publication Data

US 2010/0130394 A1 May 27, 2010

(30) Foreign Application Priority Data

Apr. 23, 2007 (JP) ..... 2007-113316
Oct. 11, 2007 (JP) ..... 2007-265369
Dec. 4, 2007 (JP) ..... 2007-313553

(51) Int. Cl.
*C10M 129/68* (2006.01)

(52) U.S. Cl. ..... 508/459; 508/478; 508/479; 508/483; 508/492; 508/493; 508/495

(58) Field of Classification Search ..... 508/478, 508/479, 483, 492, 493, 495, 459
See application file for complete search history.

(56) References Cited

U.S. PATENT DOCUMENTS

| | | | | |
|---|---|---|---|---|
| 2,351,280 A | | 6/1944 | Morgan | |
| 3,067,239 A | | 12/1962 | Mills et al. | |
| 3,359,302 A | | 12/1967 | Medley et al. | |
| 3,413,223 A | * | 11/1968 | Forbes al. | 508/296 |
| 3,555,057 A | | 1/1971 | Parker et al. | |
| 3,660,467 A | | 5/1972 | Gould et al. | |
| 4,892,680 A | | 1/1990 | Ishida | |
| 5,164,122 A | * | 11/1992 | Lange et al. | 508/308 |
| 5,686,398 A | | 11/1997 | Minokami et al. | |
| 5,798,319 A | * | 8/1998 | Schlosberg et al. | 507/138 |
| 5,912,212 A | | 6/1999 | Igarashi et al. | |

FOREIGN PATENT DOCUMENTS

| | | |
|---|---|---|
| DE | 39 40 803 A1 | 6/1991 |
| JP | 63 66293 | 3/1988 |
| JP | 1 287061 | 11/1989 |
| JP | 1 316340 | 12/1989 |
| JP | 2 45596 | 2/1990 |
| JP | 6 200277 | 7/1994 |
| JP | 7 267904 | 10/1995 |
| JP | 8 3173 | 1/1996 |
| JP | 9 183991 | 7/1997 |
| JP | 2000 119672 | 4/2000 |
| WO | 2004 087847 | 10/2004 |
| WO | 2006 059687 | 6/2006 |

OTHER PUBLICATIONS

Extended European Search Report issued on May 11, 2011 in the corresponding European Application No. 08740728.4.

B. Tabenkin, et al., "Evaluation of Esters of Phenylacetic Acid as Precursors of Penicillin G", Archives of Biochemistry, Academic Press, vol. 38, XP009147685, Jan. 1, 1952, 6 Pages.

Michael P. Marino, et al., "Phosphate Esters", CRC Handbook of Lubrication and Tribology, CRC Press, XP007918447; Jan. 1, 1993, pp. 269-286.

G. Darzens, et al., "Preparation De Quelques Glycerides Phenylaliphatiques et Leur Reduction en Alcools Correspondants. Application a La Preparation De L'Alcool Phenylethylique", Comptes Rendus Hebdomadaires Des Seances De L'Academie Des-sciences, Gauthier-Villars, vol. 205, XP002055694, Oct. 18, 1937, pp. 682-684.

H. A. Shonle, et al., "New Benzyl Esters Possessing an Anti-Spamodic Action", Journal of the American Chemical Society, vol. 43, No. 2, XP007918446, Feb. 1, 1921, pp. 361-365.

European Office Action issued Jan. 11, 2012, in Patent Application No. 08 740 728.4.

Office Action issued Jun. 6, 2012 in European patent application No. 08740728.4.

Kimura et al, J. Org. Chem. 1990, vol. 55, No. 16, pp. 4887-4892.

Portnoy et al, Industrial & Engineering Chemistry Chemical & Engineering Data Series, 1958, vol. 3, No. 2, pp. 287-293.

* cited by examiner

*Primary Examiner* — James Goloboy
*Assistant Examiner* — Taiwo Oladapo
(74) *Attorney, Agent, or Firm* — Oblon, Spivak, McClelland, Maier & Neustadt, L.L.P.

(57) ABSTRACT

A hydraulic fluid of the present invention contains, as a base oil, an ester having two or more ring structures, the two or more ring structures being at least one selected from an aromatic ring and a saturated naphthenic ring. Particularly, the hydraulic fluid contains an ester having two or more aromatic rings as the base oil. The hydraulic fluid has low energy loss due to compression and exhibits excellent responsiveness when being used in a hydraulic circuit. Consequently, the hydraulic fluid realizes energy-saving, high-speed operation and high precision of control in the hydraulic circuit.

10 Claims, No Drawings

HYDRAULIC FLUID AND HYDRAULIC SYSTEM

RELATED APPLICATION

This application is a national stage entry of PCT/JP2008/057686, filed Apr. 21, 2008 which claims priority from Japanese Patent Application No. 2007-313553, filed Dec. 4, 2007, Japanese Patent Application No. 2007-265369, filed Oct. 11, 2007, and Japanese Patent Application No. 2007-113316, filed Apr. 23, 2007, which are incorporated by reference in their entirety.

TECHNICAL FIELD

The present invention relates to a hydraulic fluid having a high bulk modulus and a hydraulic system using the hydraulic fluid.

BACKGROUND ART

A variety of hydraulic equipments using a hydraulic fluids such as a construction machine, an injection molding machine, a press machine, a crane and a machining center have been widely used. A variety of oils have been used in these hydraulic equipments (see, for instance, Patent Document 1 or 2).

Patent Document 1 discloses a hydraulic fluid for a vibration suppression damper that has bulk modulus of 1.3 or more, a viscosity index of 110 or more and a pour point of minus 25 degrees C. or less, and is specifically arranged to include poly α-olefin, polyol ester and polyether.

Patent Document 2 discloses a lubricating oil, e.g. a compressor oil, a turbine oil and a hydraulic fluid, that is used for a lubricating system requiring a large working load, and is arranged to include alkyl diphenyl and alkyl diphenyl ether.

Patent Document 1: JP-A-2000-119672

Patent Document 2: JP-A-6-200277

DISCLOSURE OF THE INVENTION

Problems to Be Solved by the Invention

When a working pressure applied on a hydraulic fluid to be used becomes 20 MPa or more in a hydraulic equipment, unignorable amount of energy loss is caused on account of decrease in volume of the hydraulic fluid by compression. A volume change rate of the fluid by compression and power loss (energy loss) rate in accordance with the volume change rate are represented by the following formulae (1) and (II), in which P represents compression pressure and K represents bulk modulus.

$$\text{Volume change rate}=\Delta P/K \quad \text{(I)}$$

$$\text{Power loss rate}=\Delta P/(2K) \quad \text{(II)}$$

For instance, when a mineral oil having bulk modulus K of 1.4 GPa is used at 28 MPa, according to the above formulae (1) and (II), a volume is decreased by 2% and hydraulic energy is maintained as 1% elastic energy in the mineral oil, but the elastic energy is not recovered and ends up in energy loss. Especially, in an axial piston pump in which a concave piston is provided for decreasing a moving mass, such an arrangement that dead volume is set to be the same as displacement volume even in full stoke has been widely used, which causes 2% energy loss. With an arrangement of a variable stroke pump operating at a constant pressure or at a constant force, operation will be mostly at a high pressure and with a low stroke volume. Accordingly, displacement volume is decreased and dead volume is increased, whereby power loss reaches a 10% level of maximum input power rating in a short time.

On the other hand, performance of a servo hydraulic control circuit is almost determined by a response speed and stability and depends on a natural angular frequency $\omega_0$ and a damping coefficient D of a control loop in the servo hydraulic control circuit. Since both the natural angular frequency $\omega_0$ and the damping coefficient D are preferably large and are in direct proportion to bulk modulus $K^{1/2}$, increase in the K value of a hydraulic fluid leads to high-speed operation in the hydraulic circuit and high precision of hydraulic control.

From the above, it is recognized that the K value of the hydraulic fluid is required to be set high. However, mineral oil compounds and fatty acid ester compounds that have been conventionally used and a conventional base oil for a hydraulic fluid disclosed in Patent Document 1 have low bulk modulus K. On the other hand, water hydraulic fluids and phosphate compounds have relatively high bulk modulus, but have poor lubricity and thermal stability, so that the water hydraulic fluids and the phosphate compounds are unusable under such severe conditions at a high temperature and a high pressure.

The hydraulic fluid in use is sensitive to a factory fire such that the water hydraulic fluids and the phosphate compounds are used as fire resistant hydraulic fluids. Accordingly, low molecular compounds such as ethylene glycol and diethylene glycol are not usable because of a low flash point although having relatively high bulk modulus. The flash point is required to be 200 degrees C. at the lowest.

Other synthetic lubricating oils may be used as a base oil for the hydraulic fluid. Among such base oils, polyphenyl ether having high bulk modulus as disclosed in Patent Document 2 has a low viscosity index, poor low-temperature fluidity and is more expensive than other compounds. Accordingly, polyphenyl ether is not suitable for use.

In view of the above points, an object of the present invention is to provide a hydraulic fluid that has high bulk modulus, reduces energy loss and is excellent in responsiveness and stability of hydraulic pressure, and a hydraulic system using the hydraulic fluid.

Means for Solving the Problems

A hydraulic fluid according to an aspect of the invention includes, as a base oil, an ester having two or more ring structures, the two or more ring structures being at least one selected from an aromatic ring and a saturated naphthenic ring.

According to the aspect of the invention, since the ester that has two or more ring structures, the two or more ring structures being at least one selected from an aromatic ring and a saturated naphthenic ring, is used as a base oil, a hydraulic fluid having high bulk modulus, lubricity and thermal stability can be provided.

In the aspect of the invention, a preferable arrangement of such an ester is exemplified by dibasic acid diester, diester of diol or diester or triester of triol. Particularly, it is preferable that at least one of ring structures is an aromatic ring in these esters.

According to the aspect of the invention, since the ester having a predetermined structure as noted above is used as the base oil, a hydraulic fluid more excellent in bulk modulus, lubricity and thermal stability can be provided.

Moreover, in the aspect of the invention, such an ester is a carboxylic acid ester having two or more aromatic rings.

According to the aspect of the invention, since the carboxylic acid ester having two or more aromatic rings is used as the base oil, bulk modulus, lubricity and thermal stability are improved. In other words, low energy loss due to compression, excellent responsiveness when being used, for instance, in a hydraulic circuit, and energy-saving, high-speed operation and high precision of control in the hydraulic circuit are obtained. Moreover, high density of the carboxylic acid ester results in a small difference between a concentration of dissolved gas under high pressure and a concentration of dissolved gas under ambient pressure, so that less air bubbles are generated, for example, in a reservoir tank. Even if air bubbles are generated, a difference in relative density between the carboxylic acid ester and the air bubbles is large, so that air bubble can be separated easily. Accordingly, decrease in control of hydraulic pressure, occurrence of cavitation and erosion caused by generation of air bubbles can be prevented. As noted above, the compound according to the aspect of the invention is highly effective also in a low-pressure hydraulic circuit and is excellent in applicability.

The hydraulic fluid according to the aspect of the invention preferably includes, as the base oil, the carboxylic acid ester having at least two aromatic rings at a position of carboxylic acid and/or a position of alcohol in any one of the above esters.

According to the aspect of the invention, since the ester as the base oil has at least two aromatic rings at the position of carboxylic acid and/or at the position of alcohol, bulk modulus, lubricity and thermal stability are improved. In other words, low energy loss due to compression, excellent responsiveness when being used, for instance, in a hydraulic circuit, and energy-saving, high-speed operation and high precision of control in the hydraulic circuit are obtained. Moreover, high density of the hydraulic fluid results in a small difference between a concentration of dissolved gas under high pressure and a concentration of dissolved gas under ambient pressure, so that less air bubbles are generated, for example, in a reservoir tank. Even if air bubbles are generated, a difference in relative density between the carboxylic acid ester and the air bubbles is large, so that air bubble can be easily separated. Accordingly, decrease in control of hydraulic pressure, occurrence of cavitation and erosion caused by generation of air bubbles can be prevented. As noted above, the compound according to the aspect of the invention is highly effective also in a low-pressure hydraulic circuit and is excellent in applicability.

According to the aspect of the invention, the carboxylic acid ester is a compound containing an aromatic ester skeleton structure represented by a formula (1) below.

[Chemical Formula 1]

(1)

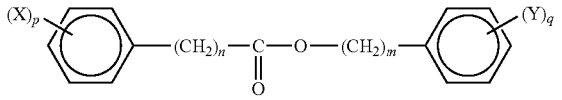

where: n and m each are 0 or 1, p and q each are an integer of 0 to 3;

X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30.

Accordingly, using the carboxylic acid ester having the aromatic ester skeleton structure represented by the above general formula (1) provides a specific working effect that bulk modulus is increased while keeping low friction coefficient.

When n or m is an integer of 2 or more in the general formula (1), bulk modulus may unfavorably become low. For this reason, a carboxylic acid ester in which n and m are 0 or 1 is used.

When p or q is an integer of 4 or more in the general formula (1), a kinematic viscosity may become higher than is necessary. For this reason, a carboxylic acid ester in which p and q each are an integer of 0 to 3 is used.

In the general formula (1), X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30. When a total number of carbon atoms of the alkyl group, the alkyloxycarbonyl group and the alkylcarbonyloxy group represented by X and Y is 31 or more, a kinematic viscosity may become excessively high. When X and Y represent a cycloalkyl group and an aromatic group having carbon atoms of 13 or more, a low-temperature fluidity may be deteriorated and the kinematic viscosity becomes excessively high.

According to the aspect of the invention, the carboxylic acid ester is a compound containing a phenyl benzoate skeleton structure represented by a formula (2) below.

[Chemical Formula 2]

(2)

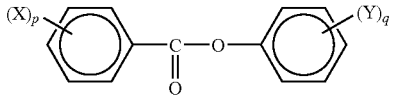

p and q each are an integer of 0 to 3;

X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30.

Accordingly, using the carboxylic acid ester having the phenyl benzoate skeleton structure represented by the above general formula (2) provides a specific working effect that bulk modulus is further increased.

When p or q is an integer of 4 or more in the general formula (2), a kinematic viscosity may become excessively high. For this reason, a carboxylic acid ester in which p and q each are an integer of 0 to 3 is used.

In the general formula (2), X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30. When a total number of carbon atoms of the alkyl group, the alkyloxycarbonyl group and the alkylcarbonyloxy group represented by X and Y is 31 or more, a kinematic viscosity may become excessively high. When X and Y represent a cycloalkyl group and an aromatic group having carbon atoms of 13 or more, low-temperature fluidity may be deteriorated and the kinematic viscosity becomes excessively high.

According to the aspect of the invention, the carboxylic acid ester is a compound containing an aromatic carboxylic acid diester skeleton structure of diol represented by a formula (3) below.

[Chemical Formula 3]

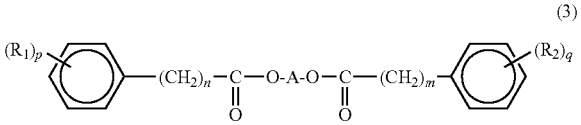

(3)

where: n and m each are 0 or 1, p and q each are an integer of 0 to 3;

$R_1$ and $R_2$ represent hydrogen or an alkyl group having carbon atoms of 1 to 10; and A represents an alkylene group having carbon atoms of 2 to 18 that may contain oxygen in a main chain or include a side chain.

Accordingly, using a carboxylic acid ester having an aromatic carboxylic acid diester skeleton structure of diol represented by the above general formula (3) provides a specific working effect that bulk modulus is further increased.

When n or m is an integer of 2 or more in the general formula (3), bulk modulus may unfavorably become low. For this reason, a carboxylic acid ester in which n and m are 0 or 1 is used.

When p or q is an integer of 4 or more in the general formula (3), a kinematic viscosity may become excessively high. For this reason, a carboxylic acid ester in which p and q each are an integer of 0 to 3 is used.

Moreover, in the general formula (3), $R_1$ and $R_2$ represent hydrogen or an alkyl group having carbon atoms of 1 to 10. When $R_1$ and $R_2$ are alkyl groups whose carbon atoms are respectively 11 or more, a kinematic viscosity may become excessively high. When A is an alkylene group having carbon atoms of 19 or more that may contain oxygen in a main chain and include a side chain, a kinematic viscosity may become excessively high.

According to the aspect of the invention, the carboxylic acid ester is a compound containing an aromatic alcohol diester skeleton structure represented by a formula (4) below.

Z represents an alkylene group having carbon atoms of 1 to 18 that may include a side chain.

Using a carboxylic acid ester having an aromatic alcohol diester skeleton structure of dibasic acid represented by the above formula (4) provides a specific working effect that bulk modulus is increased while keeping low friction coefficient.

When j and k each are an integer of 2 or more, and n or m is an integer of 3 or more in the general formula (4), bulk modulus may unfavorably become low. For the reason, a carboxylic acid ester in which j and k are 0 or 1 and n and m each are an integer of 0 to 2 is used.

When p or q is an integer of 4 or more in the general formula (4), a kinematic viscosity may become excessively high. For this reason, a carboxylic acid ester in which p and q each are an integer of 0 to 3 is used.

Moreover, in the general formula (4), $R_1$ and $R_2$ represent hydrogen or an alkyl having carbon atoms of 1 to 10. When $R_1$ and $R_2$ are alkyl groups whose total carbon atoms are 11 or more, a kinematic viscosity may become excessively high.

When Z is an alkylene group having carbon atoms of 19 or more that may include a side chain, a kinematic viscosity may become excessively high.

According to the aspect of the invention, the hydraulic fluid preferably contains 10 mass % or more of the ester as the base oil.

The base oil includes a carboxylic acid ester of 10 mass % or more, preferably 30 mass % or more, more preferably 40 mass % or more.

Accordingly, a specific working effect that bulk modulus is increased is provided.

When the carboxylic acid ester is less than 10 mass %, there may be little advantage that bulk modulus is increased. Accordingly, a carboxylic acid ester of 10 mass % or more, preferably 30 mass % or more, more preferably 40 mass % or more is preferably contained.

According to the aspect of the invention, the ester having the aromatic ring preferably has one or more nitro groups.

In the aspect of the invention, providing an aromatic ester having a predetermined number of the nitro group increases bulk modulus. Accordingly, the hydraulic fluid containing the aromatic ester as the base oil is unlikely to contract in volume under compression, for instance, when being used in a hydraulic system, thereby reducing energy loss and saving energy.

A hydraulic fluid according to another aspect of the invention includes, as a base oil, an aromatic ester having one or more nitro groups.

In the aspect of the invention, the aromatic ester having a predetermined number of the nitro group exhibits high bulk modulus. Accordingly, the hydraulic fluid containing the aromatic ester as the base oil is unlikely to contract in volume under compression, for instance, when being used in a hydraulic equipment, thereby reducing energy loss and saving energy.

[Chemical Formula 4]

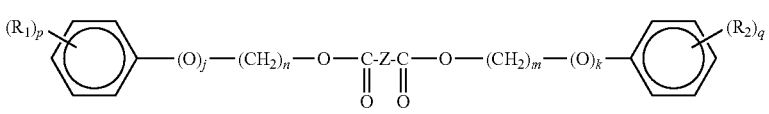

(4)

where: j and k each are 0 or 1; n and m each are an integer of 0 to 2;

p and q each are an integer of 0 to 3;

$R_1$ and $R_2$ represent hydrogen or an alkyl group having carbon atoms of 1 to 10; and For instance, when the hydraulic system is provided with a servo hydraulic control circuit, natural angular frequency $\omega_0$ and a damping coefficient D of the control loop becomes large because the hydraulic fluid has high bulk modulus. Accordingly, excellent responsiveness and stability of hydraulic pressure and high-speed operation in hydraulic circuit and high precision in hydraulic control are obtained.

Moreover, high density of the hydraulic fluid results in a small difference between a concentration of dissolved gas under high pressure and a concentration of dissolved gas under ambient pressure, so that less air bubbles are generated, for example, in a reservoir tank. Even if air bubbles are generated, a difference in relative density between the carboxylic acid ester and the air bubbles is large, so that air bubble can be easily separated. Accordingly, decrease in control of hydraulic pressure, occurrence of cavitation and erosion caused by generation of air bubbles can be prevented. Accordingly, a pump lifetime is extendable. As noted above, the hydraulic fluid according to the aspect of the invention is highly effective also in a low-pressure hydraulic circuit and is excellent in applicability.

The aromatic ester is an ester compound derived from at least one compound selected from nitro-aromatic carboxylic acid, nitrophenol and nitro-aromatic alcohol.

With this arrangement, the aromatic ester is the ester compound derived from at least one compound selected from nitro-aromatic carboxylic acid, nitrophenol and nitro-aromatic alcohol, thereby favorably providing a specific working effect that bulk modulus is increased.

The aromatic ester of the aspect of the invention may be produced by a typical esterification method and the method is not particularly limited.

Examples of raw material of the aromatic ester include a carboxylic acid, a carboxylic acid ester, a carboxylic acid chloride or derivatives thereof or alcohol or derivatives thereof.

An aromatic ring of the aromatic ester may be substituted or unsubstituted with an alkyl group and the like. The alkyl group may be introduced after or before esterification.

Esterification may be carried out with or without a catalyst. Examples of such an esterification catalyst includes Lewis acid, organic acid, inorganic acid, derivatives thereof and a mixture thereof.

Examples of Lewis acid include titanium alkoxide such as tetraisopropyl titanate, titanium halide, zinc halide, tin halide, aluminum halide, iron halide, boron trifluoride, derivatives thereof or a mixture thereof.

Examples of the organic acid include aryl sulfonates such as p-toluene sulfonate, alkyl sulfonates such as trifluoromethanesulfonate and trichloromethanesulfonate, derivatives thereof or a mixture thereof and a sulfonate ion exchange resin.

Examples of the inorganic acid include hydrochloric acid and sulfuric acid.

The nitro-aromatic carboxylic acid is preferably nitrobenzoic acid.

With this arrangement, the aromatic ester derived from nitrobenzoic acid has higher bulk modulus.

10 mass % or more of the aromatic ester is preferably contained as the base oil.

With this arrangement, an effect to increase bulk modulus is further enhanced by providing the aromatic ester of the content of 10 mass % or more. Accordingly, the content of the nitrobenzoic acid ester is 10 mass % or more, preferably 30 mass % or more, more preferably 40 mass % or more. Further, the nitrobenzoic acid ester may occupy the entire content of the base oil (i.e. 100 mass %).

When the hydraulic fluid of the aspect of the invention and base oils other than nitrobenzoic acid esters are mixed in use, the base oils having high bulk modulus, e.g. phthalate such as benzyl isononyl phthalate, isophthalate, salicylate ester, p-hydroxybenzoic acid ester and trimellitic acid ester, are preferable when being mixed with a large amount because bulk modulus of a mixture is maintained at a high level. When being mixed with a small amount, a mineral oil such as a paraffinic oil and a naphthenic oil, polybutene, alkyl diphenyl ether, poly-alpha-olefin, polyol ester and diester are used without any particular limitation.

Moreover, an additive may be added to the hydraulic fluid. Examples of the additives include a viscosity index improver, antioxidant, detergent dispersant, friction modifier, metal deactivator, pour point depressant, antiwear agent, antifoaming agent, and extreme pressure agent.

The hydraulic fluid of the aspect of the invention may be not only used as a hydraulic fluid in a hydraulic circuit under high pressure but also used as a synthetic lubricating oil. Specific application is cutting oil, grinding oil, rolling oil, deep drawing oil, blanking oil, drawing oil, press oil, forging oil, slideway oil, electric insulating oil, gasoline engine oil, diesel engine oil, air compressor oil, turbine oil, gear oil, compressor oil, vacuum pump oil, bearing oil, thermal medium oil, mist oil, refrigerating machine oil, rock drill oil, brake oil or torque converter oil. Even when being used as the synthetic lubricating oil for such a use, the hydraulic fluid with the above-mentioned arrangement according to the aspect of the invention exhibits an excellent effect particularly under pressure.

A hydraulic fluid according to still another aspect of the invention has properties of (a) to (f) below:

(a) kinematic viscosity (40 degrees C.): from 15 to 100 $mm^2/s$;

(b) pour point: −10 degrees C. or less;

(c) density (15 degrees C.): 1.0 g/ml or more;

(d) tangential bulk modulus (K value) at 40 degrees C. and 50 MPa: 1.65 GPa or more;

(e) flash point: 200 degrees C. or more; and (f) constituent elements: carbon, hydrogen, oxygen and nitrogen.

When the kinematic viscosity at 40 degrees C. is less than 15 $mm^2/s$, leakage from sealing parts is increased. When the kinematic viscosity at 40 degrees C. exceeds 100 $mm^2/s$, flow resistance becomes too large, whereby consumption energy is unfavorably increased. A preferable range of the kinematic viscosity depends on an instrument and is generally undeterminable. However, in view of energy-saving, the range of the kinematic viscosity is preferably low as long as leakage and lubricity are in an allowable range.

When a pour point is higher than −10 degrees C., the hydraulic fluid becomes solidified even inside a working site in winter, so that equipments are not unfavorably operationalized. The lower than −10 degrees C. the pour point is, the more preferable the pour point is: i.e., the pour point has no lower limit.

When the density is lower than 1.0 g/ml, bulk modulus is unfavorably decreased since molecular free volume is decreased. The higher the density is, the more preferable the density is: i.e., the density has no upper limit.

When tangential bulk modulus (K value) at 40 degrees C. and 50 MPa is lower than 1.65 GPa, the K value becomes close to K values of typical mineral oils and ester base oils, so that improvements in compression energy loss, responsiveness of hydraulic pressure and stability unfavorably provide less advantage. The higher the tangential bulk modulus is, the more preferable the tangential bulk modulus is: i.e., the tangential bulk modulus has no upper limit.

When a flash point is lower than 200 degrees C., danger of fire in a working site is unfavorably increased.

The constituent elements are required to be selected from environmentally friendly elements, i.e., carbon, hydrogen, oxygen and nitrogen, in order to provide disposal of waste fluid and biodegradability to the hydraulic fluid in view of environmental compatibility.

In order that the above-mentioned constituent elements (f): carbon, hydrogen, oxygen and nitrogen, have the above-mentioned (c) and (d), it is required that an atom density in a molecule is high and a free volume of the molecule is small. It is preferable to have two or more ring structures in the molecule for obtaining a high atom density in the molecule. Further, it is preferable that one or more of the ring structures include an aromatic ring to increase intermolecular force. It is only required to increase intermolecular force for obtaining a small free volume of the molecule. For this purpose, it is effective to introduce an ester bond, carbonate ester bond, ether bond, amide bond, hydroxyl group, nitro group, amino group and the like, and introduce oxygen and nitrogen to a constituent element of the ring to provide a polarity thereto. However, an excessive amount causes crystallization and extreme increase in a kinematic viscosity, whereby the hydraulic fluid deviates from the above (a) and (b). For providing the kinematic viscosity of 100 $mm^2/s$ or less, a molecular weight of a 2-ring compound is approximately 500 or less and a molecular weight of a 3-ring compound is approximately 400 or less as a target although generally undeterminable due to a difference depending on a molecular structure. Moreover, for providing the kinematic viscosity of 15 $mm^2/s$ or more, a molecular weight is approximately 200 or more as a target although generally undeterminable due to a difference depending on a molecular structure. For providing the pour point of −10 degrees C. or less, it is preferable to provide a flexible structure such as an alkylene chain in a molecule for avoiding crystallization, to break symmetry of a molecule and to provide a mixture for cryoscopy. A molecular weight is required to be at least approximately 200 to have the above (e). With such a molecular design, a base oil suitable as a hydraulic fluid containing properties of the above (a) to (f) is producible.

A hydraulic system according to further aspect of the invention is characterized in using any one of the above-mentioned hydraulic fluids.

According to the hydraulic system of the aspect of the invention, any one of the above-mentioned hydraulic fluids, where bulk modulus, lubricity and thermal stability are all high, is used. Accordingly, the hydraulic system of the aspect of the invention is suitable as a relatively high-pressure hydraulic system such as a construction machine, an injection molding machine, a press machine, a crane, a machining center, a hydrostatic continuously variable transmission, a robot and a machine tool.

Moreover, the hydraulic system of the aspect of the invention is suitable as a hydraulic circuit of a low-pressure hydraulics, further a servo hydraulic control circuit, and a hydraulic system such as a damper, a brake system and a power steering.

Further, the hydraulic system may be provided with a hydraulic pump. Examples of the hydraulic pump include a turbo hydraulic pump and a positive displacement pump, or a gear pump, a vane pump, a screw pump, an axial piston pump and a radial piston pump.

BEST MODE FOR CARRYING OUT THE INVENTION

First Exemplary Embodiment

A first exemplary embodiment of the invention will be described in detail below.

[Arrangement of Base Oils]

A hydraulic fluid in the first exemplary embodiment includes a specific ester as a base oil and an additive as necessary.

The specific ester is an ester that has two or more ring structures, the two or more ring structures being at least one selected from an aromatic ring and a saturated naphthenic ring. A preferable arrangement of such an ester is exemplified by dibasic acid diester, diester of diol or diester or triester of triol. Particularly, it is preferable that at least one of the ring structures is an aromatic ring in such an ester.

A manufacturing method of synthesizing the above ester of the first exemplary embodiment will be described in detail below. The ester is easily obtainable by reacting carboxylic acids, carboxylic acid esters, carboxylic acid chlorides or derivatives thereof with alcohol or derivatives thereof.

The aromatic ring or naphthenic ring may be substituted by an alkyl group, a nitro group or a hydroxyl group. A raw material including these substituents is typically used. However, when being substituted by an alkyl group, the raw material may be initially esterified, followed by alkylation.

The material includes: an aromatic carboxylic acid such as benzoic acid, toluic acid, phenylacetic acid, phenoxyacetic acid, nitrobenzoic acid, salicylic acid, p-hydroxybenzoic acid, phthalic acid, isophthalic acid, terephthalic acid, trimellitic acid, pyromellitic acid and derivatives thereof; an alicyclic carboxylic acid such as cyclohexane carboxylic acid and a derivative of thereof; a dibasic acid such as adipic acid, azelaic acid, sebacic acid and derivatives thereof; aromatic alcohol such as phenol, cresol, xylenol, alkyl phenol, benzil alcohol, phenethyl alcohol and phenoxy ethanol; alicyclic alcohol such as cyclohexanol, methyl cyclohexanol, cyclohexane methanol, norbornane methanol, borneol and isoborneol; diol such as ethylene glycol, diethylene glycol, triethylene glycol, propylene glycol, dipropylene glycol, tripropylene glycol, neopentyl glycol, 1,4-butanediol and 1,6-hexanediol; triol such as glycerin and trimethylol propane. However, the raw material is not limited to these examples.

When biodegradable carboxylic acid and alcohol such as benzoic acid, salicylic acid, terephthalic acid, p-hydroxybenzoic acid, phenol, benzil alcohol, 2-phenethyl alcohol, 2-phenoxy ethanol, adipic acid, azelaic acid and sebacic acid are used as the raw material, a biodegradable ester is obtained.

In this exemplary embodiment, the hydraulic fluid including a carboxylic acid ester having two or more aromatic rings is particularly preferably used. Such a carboxylic acid ester is preferably at least any one of: a compound including an aromatic ester skeleton structure represented by a general formula (1) below; a compound including a phenyl benzoate skeleton structure represented by a general formula (2) below; an aromatic carboxylic acid diester compound of diol represented by a general formula (3) below; and an aromatic alcohol diester compound of a dibasic acid represented by a general formula (4) below in terms of an appropriate viscosity and high bulk modulus.

[Chemical Formula 5]

(1)

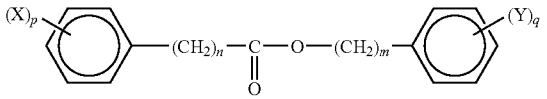

where: n and m are 0 or 1;

p and q each are an integer of 0 to 3; and

X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30.

[Chemical Formula 6]

(2)

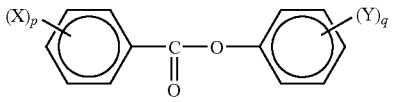

where: p and q each are an integer of 0 to 3; and

X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30.

[Chemical Formula 7]

(3)

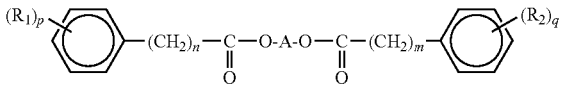

where: n and m are 0 or 1;

p and q each are an integer of 0 to 3;

$R_1$ and $R_2$ represent hydrogen or an alkyl group having carbon atoms of 1 to 10; and A represents an alkylene group having carbon atoms of 2 to 18 that may contain oxygen in a main chain or include a side chain.

In the general formula (1), X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30. When X and Y are an alkyl group, an alkyloxycarbonyl group and an alkylcarbonyloxy group whose total carbon atoms are 31 or more, a kinematic viscosity may become excessively high. When X and Y represent a cycloalkyl group and an aromatic group having carbon atoms of 13 or more, a low-temperature fluidity may be deteriorated and the kinematic viscosity becomes excessively high.

In carboxylic acid esters including the phenyl benzoate skeleton structure represented by the general formula (2), when p or q is an integer of 4 or more, a kinematic viscosity may become excessively high. For the reason, a carboxylic acid ester in which p and q each are an integer of 0 to 3 is used.

In the general formula (2), X and Y represent an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30. When X and Y are an alkyl group, an alkyloxycarbonyl group and an alkylcarbonyloxy group whose total carbon atoms are 31 or more, a kinematic viscosity may become excessively high. When X and Y are a cycloalkyl group and an aromatic group having carbon atoms of 13 or more, a low-temperature fluidity may be deteriorated and the kinematic viscosity becomes excessively high.

In carboxylic acid esters including the aromatic carboxylic acid diester compound of diol represented by the general formula (3), when n or m is an integer of 2 or more, bulk modulus may be unfavorably decreased. For the reason, a carboxylic acid ester in which n and m are 0 or 1 is used.

[Chemical Formula 8]

(4)

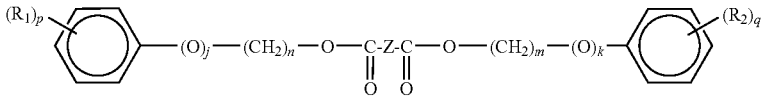

where: j and k are 0 or 1; n and m each are an integer of 0 to 2;

p and q each are an integer of 0 to 3;

$R_1$ and $R_2$ represent hydrogen or an alkyl group having carbon atoms of 1 to 10; and Z represents an alkylene group having carbon atoms of 1 to 18 that may include a side chain.

In carboxylic acid esters including the aromatic ester skeleton structure represented by the general formula (1), when n or m is an integer of 2 or more, bulk modulus may be unfavorably decreased. For the reason, a carboxylic acid ester in which n and m are 0 or 1 is used.

When p or q is an integer of 4 or more in the general formula (1), a kinematic viscosity may become excessively high. For the reason, a carboxylic acid ester in which p and q each are an integer of 0 to 3 is used.

When p or q is an integer of 4 or more in the general formula (3), a kinematic viscosity may become excessively high. For the reason, a carboxylic acid ester in which p and q each are an integer of 0 to 3 is used.

Moreover, in the general formula (3), $R_1$ and $R_2$ represent hydrogen or an alkyl group having carbon atoms of 1 to 10. When $R_1$ and $R_2$ are alkyl groups whose total carbon atoms are 11 or more, a kinematic viscosity may become excessively high. When A is an alkylene group having carbon atoms of 19 or more that may contain oxygen in a main chain and include a side chain, a kinematic viscosity may become excessively high.

In carboxylic acid esters including the aromatic alcohol diester skeleton structure of the dibasic acid represented by the general formula (4), when j or k is an integer of 2 or more and n or m is an integer of 3 or more, bulk modulus may be unfavorably decreased. For the reason, a carboxylic acid ester in which j and k are 0 or 1 and n and m each are an integer of 0 to 2 is used.

When p or q is an integer of 4 or more in the general formula (4), a kinematic viscosity may become excessively high. For the reason, a carboxylic acid ester in which p and q each are an integer of 0 to 3 is used.

Moreover, in the general formula (4), $R_1$ and $R_2$ represent hydrogen or an alkyl group having carbon atoms of 1 to 10. When $R_1$ and $R_2$ are alkyl groups whose total number of carbon atoms is 11 or more, a kinematic viscosity may become excessively high. When Z is an alkylene group having carbon atoms of 19 or more that may include a side chain, a kinematic viscosity may become excessively high.

A manufacturing method of a carboxylic acid ester having two or more aromatic rings is not particularly limited. A variety of typical manufacturing methods for esterification are applicable.

For instance, a carboxylic acids, carboxylic acid ester, carboxylic acid chloride or alcohol derivative thereof or derivative thereof are used as the raw material. The alkyl group may be provided by alkylation after esterification. Alternatively, initially alkylated raw material may be used.

An esterification catalyst is not particularly limited. Alternatively, no catalyst may be used for esterification.

The hydraulic fluid includes a carboxylic acid ester of 10 mass % or more, preferably 30 mass % or more, more preferably 40 mass % or more as the base oil.

When the carboxylic acid ester is less than 10 mass %, there may be little advantage that bulk modulus is increased. Accordingly, it is preferable to include a carboxylic acid ester of 10 mass % or more, preferably 30 mass % or more, more preferably 40 mass % or more.

[Additives]

A variety of additives can be added to the hydraulic fluid as necessary as long as an object of the invention, i.e., high bulk modulus and inhibition of energy loss when the hydraulic fluid is used in the hydraulic circuit to provide a favorable working efficiency, is obtained.

Examples of the additives include a viscosity index improver, an antioxidant, a detergent dispersant, a friction modifier, a metal deactivator, a pour point depressant, an antiwear agent, an antifoaming agent, and an extreme pressure agent.

Examples of the viscosity index improver include polymethacrylate, an olefin copolymer such as ethylene-propylene copolymer, a dispersed olefin copolymer and a styrene copolymer such as styrene-diene hydrogenated copolymer, which are used either singularly or in combination of two or more thereof. The viscosity index improvers are typically added in a range of 0.5 mass % to 10 mass %.

Examples of the antioxidant include a phenol antioxidant such as 2,6-di-t-butyl-4-methylphenol and 4,4'-methylenebis-(2,6-di-t-butylphenol), an amine antioxidant such as alkylated diphenylamine, phenyl-α-naphthylamine and alkylated-α-naphthylamine, dialkylthiodipropionate, dialkyldithiocarbamate derivative (except a metal salt), bis(3,5-di-t-butyl-4-hydroxybenzil)sulfide, mercaptobenzothiazole, a reaction product of phosphorus pentasulfide and olefin and a sulfur antioxidant such as dicetyl sulfide, which are used either singularly or in combination of two or more thereof. Particularly, the phenol antioxidant, the amine antioxidant or zinc alkyldithio phosphate, and a mixture thereof are preferably used. The antioxidants are typically added in a range of 0.1 mass % to 10 mass %.

The detergent dispersant is exemplified by alkenyl succinimide. The detergent dispersant is typically added in a range of 0.1 mass % to 10 mass %.

Examples of the metal deactivator include benzotriazole and thiadiazole, which are used either singularly or in combination of two or more thereof. The metal deactivators are typically added in a range of 0.1 mass % to 5 mass %.

The pour point depressant is exemplified by polymethacrylate. The pour point depressant is typically added in a range of 0.5 mass % to 10 mass %.

The antiwear agent is exemplified by zinc alkyldithio phosphate. The antiwear agent is typically added in a range of 0.1 mass % to 10 mass %.

Examples of the antifoaming agent include silicone compounds and ester compounds, which are used either singularly or in combination of two or more thereof. The antifoaming agents are typically added in a range of 0.01 mass % to 1 mass %.

The extreme pressure agent is exemplified by tricresyl phosphate. The extreme pressure agent is typically added in a range of 0.1 mass % to 10 mass %.

[Working Effect]

According to this exemplary embodiment, since an ester that has two or more ring structures, the two or more ring structures being at least one selected from an aromatic ring and a saturated naphthenic ring, is used as a base oil, a hydraulic fluid having high bulk modulus, lubricity and thermal stability can be obtained.

Particularly, when a carboxylic acid ester having two or more aromatic rings is used as a base oil, low energy loss due to compression, excellent responsiveness when being used, for instance, in a hydraulic circuit, and energy-saving, high-speed operation and high precision of control in the hydraulic circuit are obtained. Moreover, high density of the carboxylic acid ester results in a small difference between a concentration of dissolved gas under high pressure and a concentration of dissolved gas under ambient pressure, so that less air bubbles are generated, for example, in a reservoir tank. Even if air bubbles are generated, a difference in relative density between the carboxylic acid ester and the air bubbles is large, thereby facilitating air bubble separation. Accordingly, decrease in control of hydraulic pressure, occurrence of cavitation and erosion caused by generation of air bubbles can be prevented. As noted above, the compounds of this exemplary embodiment are highly effective also in a low-pressure hydraulic circuit and are excellent in applicability.

The carboxylic acid ester to be preferably used is at least any one selected from a compound including the aromatic ester skeleton structure represented by the general formula (1) below; a compound including the phenyl benzoate skeleton structure represented by the general formula (2) below; the aromatic carboxylic acid diester compound of diol represented by the general formula (3) below; and the aromatic alcohol diester compound of the dibasic acid represented by the general formula (4) below. Accordingly, a specific working effect of high bulk modulus is provided.

A specific working effect of providing a compound of an appropriate viscosity is obtained particularly when X and Y in the general formulae (1) and (2) are any one selected from an alkyl group that may include a cycloalkyl group or an aromatic group having carbon atoms of 1 to 30, a cycloalkyl group or an aromatic group having carbon atoms of 5 to 12, an alkyloxycarbonyl group that may include a cycloalkyl group or an aromatic group having carbon atoms of 2 to 30, or an alkylcarbonyloxy group that may include a cycloalkyl group or an aromatic group having carbon atoms of 2 to 30; $R_1$ and $R_2$ in the general formulae (3) and (4) are hydrogen or an alkyl group having carbon atoms of 1 to 10; A in the general formula (3) is an alkylene group having carbon atoms of 2 to 18 that may contain oxygen in a main chain and include a side chain; and Z in the general formula (4) is an alkylene group having carbon atoms of 1 to 18 that may include a side chain.

When a carboxylic acid ester of 10 mass % or more, preferably 30 mass % or more, more preferably 40 mass % or more is included as the base oil, a specific working effect to increase bulk modulus is obtained.

Accordingly, the hydraulic fluid of this exemplary embodiment is preferably usable in a hydraulic circuit, which is a hydraulic system in a hydraulic equipment, as a relatively high-pressure hydraulic system such as a construction machine, an injection molding machine, a press machine, a crane, a machining center, a hydrostatic continuously variable transmission, a robot and a machine tool. Moreover, the hydraulic fluid of this exemplary embodiment is preferably applicable in a hydraulic circuit of a low-pressure hydraulics, further in a servo hydraulic control circuit, a damper, a brake system and a power steering.

In the hydraulic fluid of the first exemplary embodiment, the ester having the aromatic ring contained in the base oil may include one or more nitro groups in any ring.

Thus, bulk modulus is further increased by providing an aromatic ester having a predetermined number of the nitro group. Accordingly, when a hydraulic fluid containing an aromatic ester as a base oil is used, for instance, in a hydraulic system, the hydraulic fluid becomes unlikely to contract in volume even under compression, thereby achieving low energy loss and energy-saving.

Second Exemplary Embodiment

Next, a second exemplary embodiment of the invention will be described in detail below.

It should be noted that a duplicated description of the first exemplary embodiment is omitted in this exemplary embodiment.

[Arrangement of Base Oils]

A hydraulic fluid of this exemplary embodiment includes a synthetic lubricating oil containing a nitrobenzoic acid ester having one nitro group as a base oil, or a mixture of the nitrobenzoic acid ester and a base oil other than nitrobenzoic acid esters as needed.

Examples of raw materials of the nitro benzoic acid ester include a carboxylic acid, a carboxylic acid ester, a carboxylic acid chloride or derivatives thereof and alcohol or derivatives thereof.

An aromatic ring of the nitrobenzoic acid ester may be substituted or unsubstituted with an alkyl group and the like. The alkyl group may be provided by alkylation after esterification, alternatively, by alkylation before esterification.

When the nitrobenzoic acid ester is synthesized, no catalyst may be used, but an esterification catalyst is typically used. Examples of the esterification catalyst include Lewis acid, organic acid, inorganic acid, derivatives thereof and a mixture thereof.

Examples of Lewis acid include titanium alkoxide such as tetraisopropyl titanate, titanium halide, zinc halide, tin halide, aluminum halide, iron halide, boron trifluoride, derivatives thereof and a mixture thereof.

Examples of the organic acid include aryl sulfonates such as p-toluene sulfonate, alkyl sulfonates such as trifluoromethanesulfonate and trichloromethanesulfonate, derivatives thereof and a mixture thereof and a sulfonate ion exchange resin.

Examples of the inorganic acid include hydrochloric acid and sulfuric acid.

A content of the nitrobenzoic acid ester is 10 mass % or more.

An effect to increase bulk modulus is further enhanced by providing the nitrobenzoic acid ester of the content of 10 mass % or more. Accordingly, the content of the nitrobenzoic acid ester is 10 mass % or more, preferably 30 mass % or more, more preferably 40 mass % or more. Further, the nitrobenzoic acid ester may occupy the entire content of the base oil (i.e. 100 mass %).

As the base oil other than nitrobenzoic acid esters, a base oil having high bulk modulus, e.g., phthalate such as benzyl isononyl phthalate, isophthalate, salicylate ester, p-hydroxybenzoic acid ester and trimellitic acid ester, is preferable when being mixed with a large amount in order to maintain bulk modulus of the mixture at a high level. When being mixed with a small amount, a paraffinic and naphthenic mineral oil, polybutene, alkyl diphenyl ether, poly-alpha-olefin, polyol ester and diester are used without any particular limitation.

[Additives]

As an additive to be contained in the hydraulic fluid, a viscosity index improver, antioxidant, detergent dispersant, friction modifier, metal deactivator, pour point depressant, antiwear agent, antifoaming agent, and extreme pressure agent are used as needed.

It should be noted that a description of each of the above additives is omitted in this exemplary embodiment, since the above additives are the same as those of the first exemplary embodiment.

The second exemplary embodiment may include such an arrangement that other base oils such as the carboxylic acid ester having the aromatic ring of the first exemplary embodiment is contained as the base oil of the synthetic lubricating oil contained in the hydraulic fluid. However, bulk modulus can be further increased by singularly containing an aromatic ester having a nitro group as the base oil.

[Working Effect]

According to this exemplary embodiment, the hydraulic fluid used in the hydraulic system contains the synthetic lubricating oil that includes nitrobenzoic acid ester having one nitro group as the base oil.

Accordingly, since the nitrobenzoic acid ester has a high bulk modulus, the hydraulic fluid is unlikely to contract in volume even under compression. Consequently, energy loss is reduced and energy is saved.

The hydraulic system is provided with a servo hydraulic control circuit where a natural angular frequency $\omega_0$ of the control loop and a damping coefficient D become large because of the high bulk modulus. Accordingly, high responsiveness of the hydraulic circuit and stability of hydraulic pressure control, high-speed operation and high precision of control are obtained.

A difference between a concentration of dissolved gas under high pressure and a concentration of dissolved gas under ambient pressure is small because the synthetic lubricating oil contained in the hydraulic fluid of this exemplary embodiment has a high density, so that less air bubbles are generated in a reservoir tank. Even if air bubbles are generated, a difference in a relative density between the synthetic lubricating oil and the air bubbles is large, thereby facilitating air bubble separation. Accordingly, decrease in performance of hydraulic pressure and occurrence of cavitation and erosion due to occurrence of the air bubbles can be prevented. Moreover, a pump lifetime can be extended. As noted above, the synthetic lubricating oil contained in the hydraulic fluid of the exemplary embodiment is highly effective also in a low-pressure hydraulic circuit and is excellent in applicability.

A content of the nitrobenzoic acid ester as the base oil is 10 mass % or more.

As the nitrobenzoic acid ester is contained at a specified content as the base oil, an effect to increase bulk modulus is further enhanced.

Accordingly, the hydraulic fluid of this exemplary embodiment can be suitably used in a relatively high-pressure hydraulics provided in a hydraulic equipment such as a construction machine, an injection molding machine, a press machine, a crane and a machining center. Moreover, the hydraulic fluid of this exemplary embodiment is suitably applicable to a low-pressure hydraulics such as a damper and shock-absorber.

[Modifications of Embodiments]

It should be noted that the above-described embodiments merely show exemplary embodiments of the invention, and the invention is not limited to the above-described first and second exemplary embodiments, where modifications and improvements are included within the scope of the invention as long as an object and an advantage of the invention can be achieved. Further, the specific arrangements and compositions may be altered in any manner as long as the modifications and improvements are compatible with the invention.

In other words, although the first exemplary embodiment includes the additive, the additive may not be used.

The nitrobenzoic acid ester in the synthetic lubricating oil of the second exemplary embodiment is the nitrobenzoic acid ester having one nitro group. However, meta(m)-nitrobenzoic acid, ortho(o)-nitrobenzoic acid, para(p)-nitrobenzoic acid, derivatives thereof and a mixture thereof may be used.

Although the second exemplary embodiment includes the additive, the additive may not be used.

Although the second exemplary embodiment includes nitrobenzoic acid ester of 10 mass % or more as the base oil, the content of the nitrobenzoic acid ester may be less than 10 mass %.

Although the hydraulic system of the second exemplary embodiment is provided with the servo hydraulic control circuit, the actuator and the reservoir tank, the servo hydraulic control circuit and the reservoir tank may be omitted.

EXAMPLE

Next, the first and second exemplary embodiments will be described further in detail with Examples and Comparatives.

It should be noted that the invention is not limited to the description of the following Examples and the like.

[Examples of First Exemplary Embodiment]

[Preparation of Samples]

An experiment was carried out for exemplifying performance of the hydraulic fluid of the first exemplary embodiment. In the experiment, by using various hydraulic fluids prepared under the following conditions, properties of respective hydraulic fluids, i.e. a kinematic viscosity, viscosity index, density, pour point and tangential bulk modulus, were measured and evaluated in comparison.

A kinematic viscosity was measured by a method of JIS K 2283 and a viscosity index was calculated by the method of JIS K 2283.

A density was measured by a method of JIS K 2249.

A pour point was measured by a method of JIS K 2269.

Tangential bulk modulus was a value at 40 degrees C. and 50 MPa obtained by high-pressure density measurement. In high-pressure density measurement, using a plunger type high-pressure densimeter by Saga University as described below, pressure was applied from ambient pressure to 200 MPa in a stepwise manner and measurement was carried out at 40 degrees C. A volume of the hydraulic fluid in the container was obtained by detecting a displacement of the plunger with a linear gauge.

cylinder: made of Ni—Cr—Mo steel, outer diameter of 80.0 mm, inner diameter of 29.93 mm plunger and plug: made of Cr—Mo steel High-pressure seal: made of beryllium copper Results of these properties are shown in Tables 1 to 4.

Example 1-1

To a 2-liter four-necked flask, 203 g of phthaloyl chloride (manufactured by Tokyo Chemical Industry Co., Ltd.: reagent), 600 ml of toluene (manufactured by Tokyo Chemical Industry Co., Ltd.: reagent), and 225 g of triethyl amine (manufactured by Tokyo Chemical Industry Co., Ltd.: reagent) were added. A mixture of 60 g of phenol (manufactured by Tokyo Chemical Industry Co., Ltd.: reagent) and 254 g of n-dodecanol (manufactured by Tokyo Chemical Industry Co., Ltd.: reagent) was dropped in the flask with agitation at 40 degrees C. for four hours. After further agitation for 1 hour, 30 ml of methanol (manufactured by Tokyo Chemical Industry Co., Ltd.: reagent) was added to the mixture to fully react acid chlorides.

Subsequently, washing by saturated saline and washing by 0.1 N aqueous sodium hydroxide were respectively conducted three times, followed by being dried by anhydrous magnesium sulfate (manufactured by Tokyo Chemical Industry Co., Ltd.: reagent). Further, the magnesium sulfate was filtered, and then toluene was distilled by an evaporator to obtain 140 g of fraction at a boiling point of 215 to 237 degrees C./(0.1 mmHg) by vacuum distillation.

As a result of gas chromatography analysis, this fraction was found to be a mixture of phenyl dodecyl phthalate of 84 mass % and didodecyl phthalate of 16 mass %.

This mixture, regarded as Example 1-1, was measured with respect to the above properties.

Example 1-2

In place of 203 g of phthaloyl chloride in Example 1-1, 203 g of isophthaloyl chloride (manufactured by Tokyo Chemical Industry Co., Ltd.: reagent) was used for preparation in the same manner as Example 1-1 to obtain 130 g of fraction at a boiling point of 223 to 241 degrees C./(0.1 mmHg).

As a result of analyzing the fraction in the same manner as in Example 1-1, this fraction was found to be a mixture of phenyl dodecyl isophthalate of 37 mass % and didodecyl isophthalate of 63 mass %.

This mixture, regarded as Example 1-2, was similarly measured with respect to the properties.

Example 1-3

In place of the mixture of 60 g of phenol and 254 g of n-dodecanol, a mixture of 71 g of m-cresol (manufactured by Tokyo Chemical Industry Co., Ltd.: reagent) and 254 g of n-dodecanol was used for preparation in the same manner as Example 1-1 to obtain 140 g of fraction at a boiling point of 224 to 237 degrees C./(0.1 mmHg).

As a result of analyzing the fraction in the same manner as in Example 1-1, this fraction was found to be a mixture of cresyl dodecyl phthalate of 71 mass % and didodecyl phthalate of 29 mass %.

This mixture, regarded as Example 1-3, was similarly measured with respect to the properties.

Example 1-4

To a 1-liter four-necked flask equipped with Dean-Stark apparatus, 194 g of dimethyl isophthalate (manufactured by Tokyo Chemical Industry Co., Ltd.: reagent), 140 g of benzyl alcohol (manufactured by Tokyo Chemical Industry Co., Ltd.: reagent), 220 g of n-dodecanol, and 0.2 g of tetraisopropyl titanate were added. This mixture was reacted with agitation at 140 degrees C. for four hours under nitrogen stream while distilling methanol. Subsequently, washing by saturated saline and washing by 0.1 N aqueous sodium hydroxide were respectively conducted three times, followed by being dried by anhydrous magnesium sulfate. Further, magnesium sulfate was filtered, and then 206 g of fraction at a boiling point of 211 to 230 degrees C./(0.1 mmHg) by vacuum distillation was obtained.

As a result of analyzing the fraction in the same manner as in Example 1-1, this fraction was found to be a mixture of dibenzil isophthalate of 59 mass %, benzyl dodecyl isophthalate of 35 mass % and didodecyl isophthalate of 6 mass %.

This mixture, regarded as Example 1-4, was similarly measured with respect to the properties.

Example 1-5

First, dodecyl phenol was prepared. Specifically, to a 2-liter four-necked flask, 325 g of phenol and 30 g of dried activated clay (manufactured by MIZUSAWA INDUSTRIAL CHEMICALS, LTD.: product name, Galeonite #136) were added. 575 g of 1-dodecene was dropped in this mixture with agitation at 135 degrees C. for 4 hours. The activated clay was filtered, and then 537 g of dodecyl phenol was obtained by vacuum distillation.

Benzoic acid ester was prepared by using the prepared dodecyl phenol. Specifically, to a 2-liter four-necked flask, 121 g of benzoyl chloride (manufactured by Tokyo Chemical Industry Co., Ltd.: reagent), 500 ml of toluene, and 95 g of triethyl amine were added. 225 g of dodecyl phenol that was previously prepared was dropped in the flask with agitation at 40 degrees C. for 3 hours. After further agitation for 1 hour, 30 ml of methanol was added to the mixture to fully react acid chlorides.

Subsequently, washing by saturated saline and washing by 0.1 N aqueous sodium hydroxide were respectively conducted three times, followed by being dried by anhydrous magnesium sulfate. Further, magnesium sulfate was filtered, and then toluene was distilled by an evaporator to obtain 145 g of fraction at a boiling point of 213 to 219 degrees C./(0.1 mmHg) by vacuum distillation.

As a result of analyzing the fraction in the same manner as in Example 1-1, this fraction was found to be a mixture of o-dodecyl phenol ester of 60 mass % and p-dodecyl phenol ester of 40 mass %.

This mixture, regarded as Example 1-5, was similarly measured with respect to the properties.

Example 1-6

To a 500-ml four-necked flask equipped with Dean-Stark apparatus, 25 g of methyl salicylate (manufactured by Tokyo Chemical Industry Co., Ltd.: reagent), 31 g of n-dodecanol, and 0.1 g of tetraisopropyl titanate were added. This mixture was reacted with agitation at 220 degrees C. for 2 hours under nitrogen stream while distilling methanol. After the mixture was cooled down to a room temperature, 150 ml of toluene and 28 g of triethyl amine were added to the mixture. 30 g of benzoyl chloride was dropped in the mixture with agitation at 40 degrees C. for 30 minutes. After further agitation for 1 hour, 20 ml of methanol was added to fully react acid chloride.

Subsequently, washing by saturated saline and washing by 0.1 N aqueous sodium hydroxide were respectively conducted three times, followed by being dried by anhydrous magnesium sulfate. Further, magnesium sulfate was filtered, and then 46 g of fraction at a boiling point of 220 degrees C./(0.1 mmHg) by vacuum distillation was obtained.

As a result of analyzing the fraction in the same manner as in Example 1-1, the fraction was found to be dodecyl o-benzoyloxybenzoate.

This compound, regarded as Example 1-6, was similarly measured with respect to the properties.

Example 1-7

In place of 25 g of methyl salicylate and 31 g of n-dodecanol in Example 1-6, 25 g of methyl p-hydroxybenzoate and 31 g of 2-butyl octanol were used for preparation in the same manner in Example 1-6 to obtain 48 g of 2-butyloctyl p-benzoyloxybenzoate.

This compound, regarded as Example 1-7, was similarly measured with respect to the properties.

Example 1-8

To a 500-ml four-necked flask equipped with Dean-Stark apparatus, 120 g of dimethyl terephthalate, 80 g of benzyl alcohol, 190 g of 2-hexyldecanol, and 0.2 g of tetraisopropyl titanate were added. This mixture was reacted with agitation at 140 degrees C. for 4 hours under nitrogen stream while distilling methanol.

Subsequently, washing by saturated saline and washing by 0.1 N aqueous sodium hydroxide were respectively conducted three times, followed by being dried by anhydrous magnesium sulfate. Further, after magnesium sulfate was filtered, unreacted alcohol was distilled under reduced pressure to obtain a mixture of dibenzyl terephthalate of 5 mass %, benzyl 2-hexyldecyl terephthalate of 45 mass % and di-2-hexyldecyl terephthalate of 50 mass %.

This mixture, regarded as Example 1-8, was similarly measured with respect to the properties.

Example 1-9

Bezylisononyl phthalate (manufactured by Tokyo Chemical Industry Co., Ltd.: reagent), regarded as Example 1-9, was similarly measured with respect to the properties.

Example 1-10

To a 1-liter four necked flask equipped with Dean Stark, 125 g of azelaic acid (manufactured by Tokyo Chemical Industry Co., Ltd.: reagent), 130 g of benzyl alcohol (manufactured by Tokyo Chemical Industry Co., Ltd.: reagent), 100 g of 2-phenethyl alcohol (manufactured by Tokyo Chemical Industry Co., Ltd.: reagent), 80 ml of mixed xylene (manufactured by Tokyo Chemical Industry Co., Ltd.: reagent), and 0.1 g of titanium tetraisopropoxide (manufactured by Tokyo Chemical Industry Co., Ltd.: reagent) were added and reacted with agitation at 165 degrees C. for 4 hours under nitrogen stream while distilling water. Subsequently, washing by saturated saline and washing by 0.1 N aqueous sodium hydroxide were respectively conducted three times, followed by being dried by anhydrous magnesium sulfate (manufactured by Tokyo Chemical Industry Co., Ltd.: reagent). After the magnesium sulfate was filtered, excessive alcohol was distilled to obtain a 160 g ester mixture of dibenzyl ester of 29 mass %, benzyl phenethyl ester of 50 mass % and diphenethyl ester of 21 mass %.

This mixture, regarded as Example 1-10, was similarly measured with respect to the properties.

Moreover, a 28-day biodegradability test (biodegradability: BOD) according to JIS K6950 was conducted on the mixture by using BOD tester 200F (manufactured by TAITEC Co., Ltd.), a result of the test being also shown in Table 3.

Example 1-11

To a 500-ml four necked flask equipped with Dean Stark, 180 g of methyl phenyl acetate (manufactured by Tokyo Chemical Industry Co., Ltd.: reagent), 43 g of diethylene glycol (manufactured by Tokyo Chemical Industry Co., Ltd.: reagent), and 0.1 g of titanium tetraisopropoxide (manufactured by Tokyo Chemical Industry Co., Ltd.: reagent) were added and reacted with agitation at 150 degrees C. for 4 hours under nitrogen stream while distilling water. By the same aftertreatment as in Example 1-10, 98 g of phenyl acetate diester of diethylene glycol was obtained.

This ester, regarded as Example 1-11, was similarly measured with respect to the properties.

Moreover, a 28-day biodegradability test (biodegradability: BOD) according to JIS K6950 was conducted on the mixture by using BOD tester 200F (manufactured by TAITEC Co., Ltd.), a result of the test being also shown in Table 3.

Example 1-12

In the same manner as in Example 1-11 except for reaction at 200 degrees C. for 7 hours using 225 g of methyl phenyl acetate and 27 g of glycerin in place of 180 g of methyl phenyl acetate and 43 g of diethylene glycol, 70 g of phenyl acetate triester of glycerin was obtained.

This ester, regarded as Example 1-12, was similarly measured with respect to the properties.

Moreover, a 28-day biodegradability test (biodegradability: BOD) according to JIS K6950 was conducted on the mixture by using BOD tester 200F (manufactured by TAITEC Co., Ltd.), a result of the test being also shown in Table 3.

Example 1-13

In the same manner as in Example 1-11 except for using 120 g of methyl phenyl acetate, 55 g of methyl benzoate and 36 g of 1,4-butandiol in place of 180 g of methyl phenyl acetate and 43 g of diethylene glycol, 80 g of a mixture of phenylacetic acid diester of 1,4-butandiol (48%), a phenyl acetate and benzoate of 1,4-butandiol (42 mass %), and benzoic acid diester of 1,4-butandiol (10 mass %) was obtained.

This mixture, regarded as Example 1-13, was similarly measured with respect to the properties.

Moreover, a 28-day biodegradability test (biodegradability: BOD) according to JIS K6950 was conducted on the mixture by using BOD tester 200F (manufactured by TAITEC Co., Ltd.), a result of the test being also shown in Table 3.

Example 1-14

In the same manner as in Example 1-10 except for using 150 g of 2-norbornane methanol in place of 100 g of 2-phenetyl alcohol, 155 g of an ester mixture of dibenzyl ester (20 mass %), benzyl norbornyl methyl ester (47 mass %), and dinorobornyl methyl ester (33 mass %) was obtained.

This mixture, regarded as Example 1-14, was similarly measured with respect to the properties.

Example 1-15

In the same manner as in Example 1-10 except for using 100 g of benzyl alcohol, 110 g of 2-phenoxyethanol (manufactured by Tokyo Chemical Industry Co., Ltd.: reagent), and 40 g of 2-ethylhexanol (manufactured by Tokyo Chemical Industry Co., Ltd.: reagent) in place of 130 g of benzyl alcohol and 100 g of 2-phenetyl alcohol, 165 g of an ester mixture of diphenoxyethyl ester (17 mass %), benzyl phenoxyethyl ester (31 mass %), dibenzil ester (16 mass %), phenoxyethylethylhexyl ester (17 mass %), benzilethylhexyl ester (15 mass %) and diethylhexyl ester (4 mass %) was obtained.

This mixture, regarded as Example 1-15, was similarly measured with respect to the properties.

Moreover, a 28-day biodegradability test (biodegradability: BOD) according to JIS K6950 was conducted on the mixture by using BOD tester 200F (manufactured by TAITEC Co., Ltd.), a result of the test being also shown in Table 3.

Example 1-16

To a 500-ml four necked flask equipped with Dean Stark, 245 g of methyl benzoate (manufactured by Tokyo Chemical Industry Co., Ltd.: reagent), 36 g of triethylene glycol (manufactured by Tokyo Chemical Industry Co., Ltd.: reagent), 70 g of tetraethylene glycol (manufactured by Tokyo Chemical Industry Co., Ltd.: reagent), and 0.1 g of titanium tetraisopropoxide (manufactured by Tokyo Chemical Industry Co., Ltd.: reagent) were added and reacted with agitation at 150 degrees C. for 4 hours under nitrogen stream while distilling methanol. By the same aftertreatment as in Example 1-10, 170 g of an ester mixture of benzoic acid diester of triethylene glycol (40 mass %) and benzoic acid diester of tetraethylene glycol (60 mass %) was obtained.

This ester, regarded as Example 1-16, was similarly measured with respect to the properties.

Moreover, a 28-day biodegradability test (biodegradability: BOD) according to JIS K6950 was conducted on the mixture by using BOD tester 200F (manufactured by TAITEC Co., Ltd.), a result of the test being also shown in Table 3.

Comparative 1-1

A paraffinic mineral oil (manufactured by Idemitsu Kosan Co., Ltd.: product name; Diana Fresia P90), regarded as Comparative 1-1, was similarly measured with respect to the properties.

Moreover, a 28-day biodegradability test (biodegradability: BOD) according to JIS K6950 was conducted on the mineral oil by using BOD tester 200F (manufactured by TAITEC Co., Ltd.), a result of the test being also shown in Table 4.

Comparative 1-2

Polybutene (manufactured by Idemitsu Kosan Co., Ltd.: product name; Idemitsu Polybutene 5H), regarded as Comparative 1-2, was similarly measured with respect to the properties.

Moreover, a 28-day biodegradability test (biodegradability: BOD) according to JIS K6950 was conducted on the polybutene by using BOD tester 200F (manufactured by TAITEC Co., Ltd.), a result of the test being also shown in Table 4.

Comparative 1-3

To a 2-liter four necked flask equipped with Dean Stark, 218 g of anhydrous pyromellitic acid, 650 g of n-octanol, 0.2 g of titanium tetraisopropoxide and 300 ml of xylene were added and reacted with agitation at 160 degrees C. for 4 hours under nitrogen stream while distilling water. Subsequently, washing by saturated saline and washing by 0.1 N aqueous sodium hydroxide were respectively conducted three times, followed by being dried by anhydrous magnesium sulfate. After magnesium sulfate was filtered, unreacted alcohol was distilled under diminished pressure to obtain 630 g of pyromellitic acid tetraoctyl ester as a residue. The obtained compound, regarded as Comparative 1-3, was similarly measured with respect to the properties.

Comparative 1-4

Alkyl diphenyl ether (manufactured by MATSUMURA OIL RESEARCH CORP.: product name; MORESCO-HI-LUBE LB-68), regarded as Comparative 1-4, was similarly measured with respect to the properties.

Comparative 1-5

Pentaphenyl ether (manufactured by MATSUMURA OIL RESEARCH CORP.: product name; S-3105), regarded as Comparative 1-5, was similarly measured with respect to the properties.

Moreover, a 28-day biodegradability test (biodegradability: BOD) according to JIS K6950 was conducted on the ether by using BOD tester 200F (manufactured by TAITEC Co., Ltd.), a result of the test being also shown in Table 4.

TABLE 1

| Item | Example 1-1 | Example 1-2 | Example 1-3 | Example 1-4 | Example 1-5 | Example 1-6 |
|---|---|---|---|---|---|---|
| Kinematic viscosity (40° C., $mm^2/s$) | 35.62 | 50.64 | 38.90 | 60.07 | 41.78 | 48.83 |
| Kinematic viscosity (100° C., $mm^2/s$) | 5.226 | 7.275 | 5.651 | 6.621 | 5.245 | 5.863 |
| Viscosity Index | 64 | 103 | 76 | 38 | 20 | 36 |
| Density (15° C., g/ml) | 1.0242 | 0.9882 | 1.0046 | 1.1165 | 0.9945 | 1.0425 |
| Pour Point (° C.) | −35 | −17.5 | −27.5 | −22.5 | −35 | −20 |
| Tangential bulk modulus (GPa) | 1.69 | 1.65 | 1.69 | 1.86 | 1.68 | 1.75 |

TABLE 2

| Item | Example 1-7 | Example 1-8 | Example 1-9 |
|---|---|---|---|
| Kinematic viscosity (40° C., $mm^2/s$) | 68.20 | 58.48 | 31.55 |
| Kinematic viscosity (100° C., $mm^2/s$) | 7.031 | 8.140 | 4.736 |
| Viscosity Index | 35 | 107 | 43 |
| Density (15° C., g/ml) | 1.0394 | 0.9768 | 1.0652 |
| Pour Point (° C.) | −50 | −25 | −42.5 |
| Tangential bulk modulus (GPa) | 1.75 | 1.64 | 1.81 |

TABLE 3

| Item | Example 1-10 | Example 1-11 | Example 1-12 | Example 1-13 | Example 1-14 | Example 1-15 | Example 1-16 |
|---|---|---|---|---|---|---|---|
| Kinematic viscosity (40° C., $mm^2/s$) | 17.88 | 18.54 | 58.24 | 15.34 | 28.04 | 22.05 | 32.77 |
| Kinematic viscosity (100° C., $mm^2/s$) | 4.169 | 3.707 | 6.322 | 3.401 | 5.607 | 4.382 | 4.953 |
| Viscosity Index | 141 | 74 | 25 | 91 | 144 | 107 | 58 |
| Density (15° C., g/ml) | 1.0683 | 1.1527 | 1.1769 | 1.1247 | 1.0560 | 1.0616 | 1.1698 |
| Pour Point (° C.) | −40 | −40 | −27.5 | −25 | −35 | −37.5 | −30 |
| Tangential bulk modulus (GPa) | 1.78 | 1.84 | 1.9 | 1.83 | 1.77 | 1.78 | 1.88 |
| Biodegradability (BOD) | 60% or more | 60% or more | 60% or more | 60% or more | — | 60% or more | 60% or more |

TABLE 4

| Item | Comparative 1-1 | Comparative 1-2 | Comparative 1-3 | Comparative 1-4 | Comparative 1-5 |
|---|---|---|---|---|---|
| Kinematic viscosity (40° C., $mm^2/s$) | 89.79 | 95.7 | 69.14 | 68.52 | 282.5 |
| Kinematic viscosity (100° C., $mm^2/s$) | 10.99 | 8.978 | 10.18 | 9.518 | 12.65 |
| Viscosity Index | 108 | 52 | 132 | 118 | −59 |
| Density (15° C., g/ml) | 0.8716 | 0.8403 | 0.9175 | 0.9047 | 1.2021 |
| Pour Point (° C.) | −17.5 | −30 | −5 | −30 or less | 2.5 |
| Tangential bulk modulus (GPa) | 1.51 | 1.44 | 1.56 | 1.54 | 1.98 |
| Biodegradability (BOD) | 10% or less | 10% or less | — | — | 10% or less |

As is understood from results of Tables 1 to 4, bulk modulus is low in a paraffinic mineral oil in Comparative 1-1 and synthetic oil in Comparative 1-2 which are used as a lubricating oil. Further, biodegradability is also low. Bulk modulus is low also in Comparative 1-3 since the ester of Comparative 1-3 has only one aromatic ring. In addition, bulk modulus is also low in the diphenyl ether of Comparative 1-4. In pentaphenyl ether of Comparative 1-5, bulk modulus is high, but a kinematic viscosity and a pour point are high and a viscosity index is low, so that the pentaphenyl ether is not suitable for use as a hydraulic fluid. Comparative 1-5 of pentaphenyl ether also exhibits low biodegradability.

On the other hand, each carboxylic acid ester of Examples 1-1 to 1-16 has a relatively low kinematic viscosity and pour point as well as a relatively high viscosity index, so that the each carboxylic acid ester is applicable as a hydraulic fluid. Further, the each carboxylic acid ester has relatively high bulk modulus and small energy loss by compression, thereby providing effective operation in a hydraulic circuit.

[Examples of Second Exemplary Embodiment]

[Preparation of Samples]

An experiment was carried out for confirming performance of the hydraulic fluid of the second exemplary embodiment. In the experiment, by using various hydraulic fluids prepared under the same conditions as in Examples of the first exemplary embodiments, properties of respective hydraulic fluids, i.e. a kinematic viscosity, a viscosity index, a density, a pour point and tangential bulk modulus, were measured and evaluated in comparison.

Results of these properties are shown in Tables 5 to 7.

Example 2-1

To a 500-ml four necked flask equipped with Dean-Stark apparatus, 120 g of methyl m-nitrobenzoate (manufactured by Tokyo Chemical Industry Co., Ltd.: reagent), 60 g of benzyl alcohol (manufactured by Tokyo Chemical Industry Co., Ltd.: reagent), 55 g of 2-phenethyl alcohol (manufactured by Tokyo Chemical Industry Co., Ltd.: reagent), and 0.1 g of titanium tetraisopropoxide (manufactured by Tokyo Chemical Industry Co., Ltd.: reagent) were added and reacted with agitation at 155 degrees C. for 4 hours under nitrogen stream while distilling methanol. Subsequently, washing by saturated saline and washing by 0.1 N aqueous sodium hydroxide were respectively conducted three times, followed by being dried by anhydrous magnesium sulfate (manufactured by Tokyo Chemical Industry Co., Ltd.: reagent). After magnesium sulfate was filtered, excessive alcohol was distilled to obtain a 145 g residue.

As a result of analyzing the residue by gas chromatography, the residue was found to be a mixture of benzyl m-nitrobenzoate (50 mass %) and phenethyl m-nitrobenzoate (50 mass %).

This mixture, regarded as Example 2-1, was measured with respect to the above properties Example 2-2

To 40 g of the mixed ester obtained in Example 2-1, 10 g of benzyl isononyl phthalate (manufactured by Tokyo Chemical Industry Co., Ltd.: reagent) was added. The obtained mixture, regarded as Example 2-2, was similarly measured with respect to the properties.

Example 2-3

In place of 60 g of benzyl alcohol and 55 g of 2-phenethyl alcohol in Example 2-1, 108 g of benzyl alcohol was used for preparation in the same manner as in Example 2-1 to obtain 134 g of benzil m-nitrobenzoate. Further, 134 g of benzyl isononyl phthalate was added to benzil m-nitrobenzoate. The obtained mixture, regarded as Example 2-3, was similarly measured with respect to the properties.

Example 2-4

In place of 60 g of benzyl alcohol in Example 2-1, 122 g of 2-phenethyl alcohol was used for preparation in the same manner as in Example 2-1 to obtain 150 g of phenethyl m-nitrobenzoate. Further, 150 g of benzyl isononyl phthalate was added to phenethyl m-nitrobenzoate. The obtained mixture, regarded as Example 2-4, was similarly measured with respect to the properties.

Example 2-5

To a 500-ml four necked flask equipped with Dean Stark, 50 g of m-nitrobenzoic acid (manufactured by Tokyo Chemical Industry Co., Ltd.: reagent), 100 g of benzyl alcohol (manufactured by Tokyo Chemical Industry Co., Ltd.: reagent), 30 g of n-decanol (manufactured by Tokyo Chemical Industry Co., Ltd.: reagent), 100 g of xylene (manufactured by Tokyo Chemical Industry Co., Ltd.: reagent), and 0.2 g of titanium tetraisopropoxide (manufactured by Tokyo Chemical Industry Co., Ltd.: reagent) were added and reacted with agitation at 175 degrees C. for 5 hours under nitrogen stream while distilling water. Subsequently, washing by saturated saline and washing by 0.1 N aqueous sodium hydroxide were respectively conducted three times, followed by being dried by anhydrous magnesium sulfate (manufactured by Tokyo Chemical Industry Co., Ltd.: reagent). After magnesium sulfate was filtered, excessive alcohol was distilled to obtain a 63 g residue.

As a result of analyzing the residue in the same manner as in Example 2-1, the residue was found to be a mixture of benzil m-nitrobenzoate (75 mass %) and decyl m-nitrobenzoate (25 mass %).

This mixture, regarded as Example 2-5, was similarly measured with respect to the properties.

Example 2-6

In place of 60 g of benzyl alcohol and 55 g of 2-phenethyl alcohol in Example 2-1, 158 g of 1-phenoxy-2-propanol (manufactured by Tokyo Chemical Industry Co., Ltd.: reagent) was used for preparation in the same manner as in Example 2-1 to obtain 138 g of phenoxy propyl m-nitrobenzoate. The obtained compound, regarded as Example 2-6, was similarly measured with respect to the properties.

Example 2-7

In place of 60 g of benzyl alcohol and 55 g of 2-phenethyl alcohol in Example 2-1, 200 g of a tridecanol mixture (manufactured by Tokyo Chemical Industry Co., Ltd.: reagent) was used for preparation in the same manner as in Example 2-1 to obtain 186 g of tridecyl m-nitrobenzoate. The obtained mixture, regarded as Example 2-7, was similarly measured with respect to the properties.

Example 2-8

To a 1-liter four necked flask, 50 g of 4-nitrophenyl salicylate, 500 ml of toluene and 28 g of triethyl amine were added. 35 g of n-octanoic acid chloride was dropped in the flask with agitation at 30 degrees C. for 1 hour. After further agitation for 1 hour, 40 ml of methanol was added to react all acid chlorides. Subsequently, washing by saturated saline and washing by 0.1 N aqueous sodium hydroxide were respectively conducted three times, followed by being dried by anhydrous magnesium sulfate. After magnesium sulfate was filtered, toluene and a small amount of methyl n-octanoic acid were distilled to obtain 70 g of n-octanoic acid ester of 4-nitrophenyl salicylate as a residue. The obtained compound, regarded as Example 2-8, was similarly measured with respect to the properties.

Example 2-9

To a 500-ml four necked flask equipped with Dean-Stark apparatus, 60 g of methyl m-nitrobenzoate (manufactured by Tokyo Chemical Industry Co., Ltd.: reagent), 60 g of methyl p-nitrobenzoate (manufactured by Tokyo Chemical Industry Co., Ltd.: reagent), 110 g of 2-phenethyl alcohol (manufactured by Tokyo Chemical Industry Co., Ltd.: reagent), and 0.1 g of titanium tetraisopropoxide (manufactured by Tokyo Chemical Industry Co., Ltd.: reagent) were added and reacted with agitation at 155 degrees C. for 4 hours under nitrogen stream while distilling methanol. Subsequently, washing by saturated saline and washing by 0.1 N aqueous sodium hydroxide were respectively conducted three times, followed by being dried by anhydrous magnesium sulfate (manufactured by Tokyo Chemical Industry Co., Ltd.: reagent). After magnesium sulfate was filtered, excessive alcohol was distilled to obtain a 155 g residue.

As a result of analyzing the residue by gas chromatography, the residue was found to be a mixture of phenethyl m-nitrobenzoate (50 mass %) and phenethyl p-nitrobenzoate (50 mass %).

120 g of this mixture and 80 g of benzil m-nitrobenzoate obtained in Example 2-3 were mixed and were similarly measured as Example 2-9 with respect to the properties.

Moreover, a 28-day biodegradability test (biodegradability: BOD) according to JIS K6950 was conducted on the mixture by using BOD tester 200F (manufactured by TAITEC Co., Ltd.), a result of the test being also shown in Table 6.

Comparative 2-1

A paraffinic mineral oil (manufactured by Idemitsu Kosan Co., Ltd.: product name; Diana Fresia P90), regarded as Comparative 2-1, was similarly measured with respect to the properties.

Comparative 2-2

Polybutene (manufactured by Idemitsu Kosan Co., Ltd.: product name; Idemitsu Polybutene 5H), regarded as Comparative 2-2, was similarly measured with respect to the properties.

Comparative 2-3

To a 2-liter four necked flask equipped with Dean Stark, 218 g of anhydrous pyromellitic acid, 650 g of n-octanol, 0.2 g of titanium tetraisopropoxide and 300 ml of xylene were added and reacted with agitation at 160 degrees C. for 4 hours under nitrogen stream while distilling water. Subsequently, washing by saturated saline and washing by 0.1 N aqueous sodium hydroxide were respectively conducted three times, followed by being dried by anhydrous magnesium sulfate. After magnesium sulfate was filtered, unreacted alcohol was distilled under diminished pressure to obtain 630 g of pyromellitic acid tetraoctyl ester as a residue. The obtained compound, regarded as Comparative 2-3, was similarly measured with respect to the properties.

Comparative 2-4

Alkyl diphenyl ether (manufactured by MATSUMURA OIL RESEARCH CORP.: product name; MORESCO-HI-LUBE LB-68), regarded as Comparative 2-4, was similarly measured with respect to the properties.

Comparative 2-5

Pentaphenyl ether (manufactured by MATSUMURA OIL RESEARCH CORP.: product name; S-3105), regarded as Comparative 2-5, was similarly measured with respect to the properties.

TABLE 5

| Item | Example 2-1 | Example 2-2 | Example 2-3 | Example 2-4 |
|---|---|---|---|---|
| Kinematic viscosity (40° C., $mm^2/s$) | 33.46 | 31.29 | 27.57 | 33.33 |
| Kinematic viscosity (100° C., $mm^2/s$) | 3.779 | 3.897 | 4.013 | 4.295 |
| Viscosity Index | −206 | −132 | −36 | −62 |
| Density (15° C., g/ml) | 1.2457 | 1.205 | 1.156 | 1.1416 |
| Pour Point (° C.) | −27.5 | −32.5 | −42.5 | −40.0 |
| Tangential bulk modulus (GPa) | 2.08 | 2.02 | 1.96 | 1.93 |

TABLE 6

| Item | Example 2-5 | Example 2-6 | Example 2-7 | Example 2-8 | Example 2-9 |
|---|---|---|---|---|---|
| Kinematic viscosity (40° C., $mm^2/s$) | 19.82 | 172.4 | 26.30 | 136.3 | 32.86 |
| Kinematic viscosity (100° C., $mm^2/s$) | 3.239 | 5.747 | 4.027 | 8.407 | 3.770 |
| Viscosity Index | −58 | −671 | −11 | −60 | −198 |
| Density (15° C., g/ml) | 1.199 | 1.2346 | 1.0284 | 1.1719 | 1.2413 |
| Pour Point (° C.) | −35.0 | −20.0 | −47.5 | −35.0 | −27.5 |
| Tangential bulk modulus (GPa) | 2.00 | 2.05 | 1.72 | 1.97 | 2.08 |
| Biodegradability (BOD) | — | — | — | — | 60% or less |

TABLE 7

| Item | Comparative 2-1 | Comparative 2-2 | Comparative 2-3 | Comparative 2-4 | Comparative 2-5 |
|---|---|---|---|---|---|
| Kinematic viscosity (40° C., $mm^2/s$) | 89.79 | 95.7 | 69.14 | 68.52 | 282.5 |
| Kinematic viscosity (100° C., $mm^2/s$) | 10.99 | 8.978 | 10.18 | 9.518 | 12.65 |
| Viscosity Index | 108 | 52 | 132 | 118 | −59 |
| Density (15° C., g/ml) | 0.8716 | 0.8403 | 0.9175 | 0.9047 | 1.2021 |
| Pour Point (° C.) | −17.5 | −30.0 | −5.0 | −30.0 or less | 2.5 |
| Tangential bulk modulus (GPa) | 1.51 | 1.44 | 1.56 | 1.54 | 1.98 |

As is understood from results of Tables 5 to 7, bulk modulus is low in a paraffinic mineral oil in Comparative 2-1 and synthetic oil in Comparative 2-2 which are used as a lubricating oil. In addition, bulk modulus is low also in the ester of Comparative 2-3. In addition, bulk modulus is low also in the diphenyl ether of Comparative 2-4. In the pentaphenyl ether of Comparative 2-5, bulk modulus is high, but a kinematic viscosity and a pour point are high and a viscosity index is low, so that the pentaphenyl ether is not suitable for use as a hydraulic fluid.

On the other hand, each carboxylic acid ester of Examples 2-1 to 2-9 has a relatively low kinematic viscosity and pour point, so that the each carboxylic acid ester is applicable as a hydraulic fluid. Further, the each carboxylic acid ester has relatively high bulk modulus and small energy loss by compression, thereby providing effective operation in a hydraulic circuit.

The invention claimed is:

1. A hydraulic fluid comprising an ester as a base oil, the ester having two or more ring structures, wherein the two or more ring structures are at least one selected from the group consisting of an aromatic ring and a saturated naphthenic ring, and wherein the ester is at least one compound selected from the group consisting of a compound comprising an aromatic ester skeleton of formula (1)

(1)

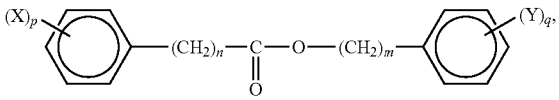

wherein n is 0 or 1, m is 0, p and q each are an integer of 0 to 3, and X and Y each represent an alkyl group that may include a cycloalkyl group or an aromatic group having 1 to 30 carbon atoms, a cycloalkyl group or an aromatic group having 5 to 12 carbon atoms, an alkyloxycarbonyl group that may include a cycloalkyl group or an aromatic group having 2 to 30 carbon atoms, or an alkylcarbonyloxy group that may include a cycloalkyl group or an aromatic group having 2 to 30 carbon atoms;

a compound comprising an aromatic ester skeleton of formula (3)

(3)

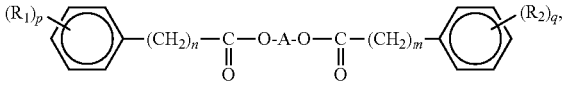

wherein n and m each are 0 or 1, p and q each are an integer of 0 to 3, $R_1$ and $R_2$ each represent hydrogen or an alkyl group having 1 to 10 carbon atoms, and A represents an alkylene group having 2 to 18 carbon atoms that may contain oxygen in a main chain and may contain a side chain; and a compound comprising an aromatic ester skeleton of formula (4)

(4)

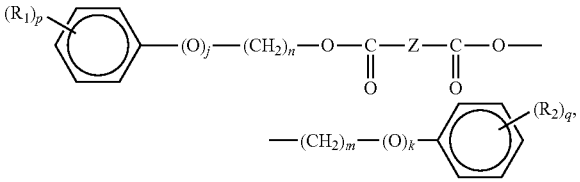

wherein j and k each are 0 or 1, n and m each are 1 or 2, p and q each are an integer of 0 to 3, $R_1$ and $R_2$ represent hydrogen or an alkyl group having 1 to 10 carbon atoms, and Z represents an alkylene group having 1 to 18 carbon atoms that may include a side chain.

2. The hydraulic fluid according to claim 1, wherein the ester is the compound comprising an aromatic ester skeleton of formula (1) and said compound comprising an aromatic ester skeleton of formula (1) is a compound comprising a phenyl benzoate skeleton structure of formula (2)

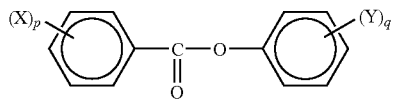

(2)

wherein p and q each are an integer of 0 to 3; and X and Y represent an alkyl group that may include a cycloalkyl group or an aromatic group having 1 to 30 carbon atoms, a cycloalkyl group or an aromatic group having 5 to 12 carbon atoms, an alkyloxycarbonyl group that may include a cycloalkyl group or an aromatic group having 2 to 30 carbon atoms, or an alkylcarbonyloxy group that may include a cycloalkyl group or an aromatic group having 2 to 30 carbon atoms.

3. The hydraulic fluid according to claim 1, wherein the hydraulic fluid contains 10 mass % or more of the ester as the base oil.

4. The hydraulic fluid according to claim 1, wherein the base oil has:

(a) a kinematic viscosity (40 degrees C.) of from 15 to 100 $mm^2/s$;

(b) a pour point of −10 degrees C. or less;

(c) a density (15 degrees C.) of 1.0 g/ml or more;

(d) a tangential bulk modulus (K value) at 40 degrees C. and 50 MPa of 1.65 GPa or more; and (e) a flash point of 200 degrees C. or more.

5. A hydraulic system comprising the hydraulic fluid according to claim 1.

6. The hydraulic fluid according to claim 1, wherein the ester is the compound comprising an aromatic ester skeleton of formula (1).

7. The hydraulic fluid according to claim 1, wherein the ester is the compound comprising an aromatic ester skeleton of formula (3).

8. The hydraulic fluid according to claim 1, wherein the ester is the compound comprising an aromatic ester skeleton of formula (4).

9. The hydraulic fluid according to claim 1, further comprising one or more additives selected from the group consisting of a viscosity index improver, an antioxidant, a detergent dispersant, a friction modifier, a metal deactivator, a pour point depressant, an antiwear agent, an antifoaming agent, and an extreme pressure agent.

10. The hydraulic fluid according to claim 3, wherein the hydraulic fluid comprises up to 90 mass % of one or more base oils other than said ester.

* * * * *